United States Patent [19]

Beerens

[11] 4,325,278

[45] Apr. 20, 1982

[54] HAND SAW GUIDE

[76] Inventor: Cornelis J. Beerens, 40-42 Berkshire Rd., North Sunshine, Victoria, Australia

[21] Appl. No.: 125,564

[22] Filed: Feb. 28, 1980

[30] Foreign Application Priority Data

Mar. 1, 1979 [AU] Australia ..... PD7861
Sep. 17, 1979 [AU] Australia ..... PE0524

[51] Int. Cl.[3] ..... B27B 21/08

[52] U.S. Cl. ..... 83/745; 83/522; 83/761; 33/469

[58] Field of Search ..... 83/745, 743, 761, 746, 83/764, 767, 829, 522; 33/452, 465, 466, 469, 471

[56] References Cited

U.S. PATENT DOCUMENTS

| | | | |
|---|---|---|---|
| 952,270 | 3/1910 | Milks | 83/761 |
| 965,785 | 7/1910 | Wilson | 83/767 |
| 1,111,904 | 9/1914 | Kahrs | 83/761 |
| 1,729,624 | 10/1929 | Meier | 83/761 |
| 2,323,319 | 7/1943 | Finnell | 83/761 |
| 2,942,634 | 6/1960 | Gathercoal | 83/761 |
| 3,717,064 | 2/1973 | Shelton | 83/761 |

FOREIGN PATENT DOCUMENTS 1478611 7/1977 United Kingdom .

*Primary Examiner*—James M. Meister
*Attorney, Agent, or Firm*—Wigman & Cohen

[57] ABSTRACT

A hand saw guide comprising a member having two right angled related surfaces so that where one surface is in face to face contact with a component to be sawn the other surface is perpendicular to the component. The other surface having incorporated therein a magnet that creates a magnetic field to hold the blade of a saw against said other surface. The saw can thus be operated to cut the component while held in guided relationship with the other surface.

9 Claims, 5 Drawing Figures

HAND SAW GUIDE

BACKGROUND OF THE INVENTION

This invention relates to a guide for use with a hand saw and is particularly intended to be used as a guide in the cutting of timber, however may equally be used for cutting other materials, including plastics and metals.

Although skilled tradesmen can operate a hand saw so that they cut in a straight line both across the width and through the thickness of a piece of material, many semiskilled and unskilled people find this difficult to achieve. In the woodworking field there is a guide arrangement known as a miter-box which may be attached to a bench, or fitted in a vice, and will receive a length of timber. The miter-box usually provides a guide for the saw whilst cutting either at right angles or at an angle of 45° to an edge of the piece of timber and in some instances includes 60° and 30° cuts. The disadvantage of these miter-boxes is that they are rather bulky and thus cannot be conveniently carried for use at different locations on a particular job. Also they require a vice or bench to support them when in use, and thus can only be used in specified areas where this auxiliary equipment is available.

OBJECTS AND SUMMARY OF THE INVENTION

It is the principal object of the present invention to provide a guide for use with a hand saw which is not dependent upon any auxiliary equipment and which may be conveniently carried for use at any required location.

With this object in view there is provided a hand saw guide comprising two angularly related members arranged so that when one member engages an edge of a workpiece, the other member may extend across a face of the workpiece, said other member being adapted to guidably engage the blade of a hand saw with the teeth thereof in cutting relation with said face of the workpiece.

Preferably the two members are pivotally connected so that the angular relation therebetween can be varied to suit the requirements of the user. Means may also be provided to lock the members in any selected angular relation, and in addition the lock means may be adapted to automatically lock the members in angular relationships frequently used, such as a right angular relationship and a 45° angular relationship in either direction.

There is also provided a hand saw guide having two faces disposed at right angles so that when one face is in contact with a workpiece face the other face of the guide is perpendicular to said workpiece face, said one face having at least two slots therein arranged at 45° to one another and with one slot at right angles to said other face, a member receivable in either selected one of said slots to extend in the direction of that slot, and means to retain said member in the selected slot, said member being adapted to engage an edge of the said workpiece face when said one face of the guide is in contact with said face of the workpiece.

In the preferred form of the guide, magnetic means are associated with said other face to produce a magnetic field that holds the steel blade of the hand saw in face to face contact with said other face. The magnetic field created by the magnetic means is of sufficient strength to hold the blade of the saw against the other face of the guide, however is not so strong as to prevent relative sliding movement between the blade and the other face so that the saw may be operated.

Conveniently there are provided two groups of two slots in said one surface of the guide member, arranged so that the slots of one set intersect in the vicinity of one end of the other face, and the other set of slots intersect in the vicinity of the opposite end of said other face. The other member may be selectively received in any one of the four slots so provided, and locked in the slots so selected. By the provision of these two sets of slots with their intersection in the vicinity of the opposite ends of the other face of the guide member, the same hand saw guide may be used by left and right handed persons with the set of slots at one end of the other face being used to receive the member when the guide is to be used by a right handed person, and the set of slots at the other end of the other face being used when the guide is to be used by a left handed person.

Preferably each of the sets of slots comprises three slots with the third slot being also inclined at 45° to the slot which is at right angles to the other face, the two 45° slots being inclined in opposite directions to the slot which extends at rights angles to the other face.

BRIEF DESCRIPTION OF THE DRAWINGS

The invention will be more readily understood from the following description of one practical arrangement of the hand saw guide as illustrated in the accompanying drawings wherein.

DETAILED DESCRIPTION OF THE PREFERRED EMBODIMENT

Figure 1:
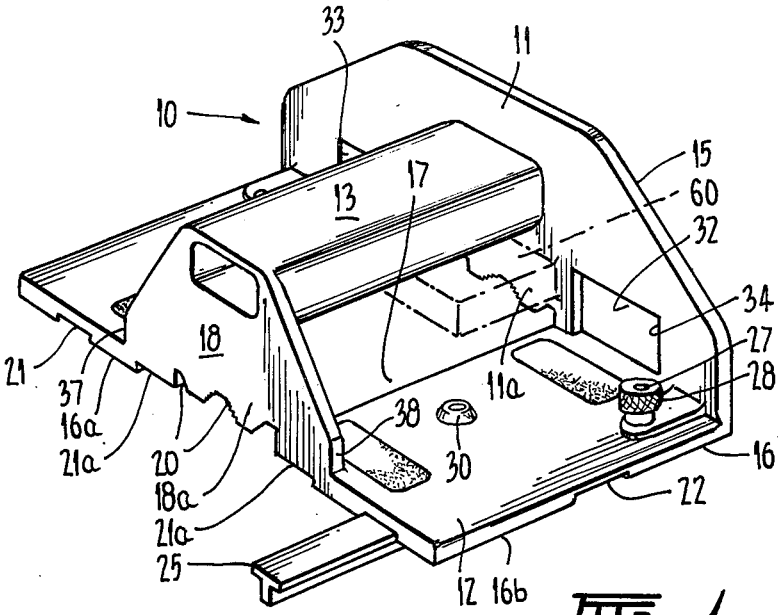
- FIG. 1 is a perspective view from above of the guide.

In one practical form of the saw guide a moulded member 10 having plate portions 11 and 12 providing two right angle related faces 15 and 16. A handgrip 13 is moulded integral with the member 10 to be gripped by the operator to hold the guide in position on the face of a workpiece. The face 16 of the guide which is use contacts the face of the workpiece discontinuously, in that it is formed by two co-planar but laterally spaced faces 16*a* and 16*b*, so that workpieces of an irregular cross-section may be received between the faces. The space 17 between the spaced faces 16*a* and 16*b* is bridged by the lower edges 11*a* and 18*a* of the plate portion 11 and handgrip support portion 18. These lower edges are provided with aligned notches 20 to receive irregular shaped workpieces so that the face 15 is disposed at right angles to the length of the workpiece. In the preferred form as shown the notches 20 are of V-shaped form.

Two rectangular apertures 32 and 33 are provided in the portion 11 of the guide each having a vertical edge face 34 and 36 inclined at an angle of 45° in mutually opposite directions to the face 15. The portion 18 of the guide also has vertical faces 37 and 38 at opposite ends thereof. The faces 34 and 37 are so disposed that a workpiece extending through the aperture 32 with one face edge in contact with the vertical faces 37 and 34, that workpiece is then located at an angle of 45° to the face 15. The faces 36 and 38 are similarly located so that a workpiece passing through the aperture 33 is also inclined at 45° to the face 15, but in the opposite direction to a workpiece extending through the aperture 32. Thus this arrangement of faces and apertures can be used for accurately locating small pieces of material to be cut at 45° angles.

Mounted in the portion 11 forming the face 15 is the magnet 35. In this arrangement the magnet 35 is of the horseshoe type and is located in an aperture in the portion 11 that aligns with the hollow interior of the handgrip 13. The magnet 35 creates a magnetic field adjacent the face 15 that attracts steel objects towards the face 15. Thus when the steel blade of a hand saw is positioned in face to face contact with the face 15, the magnet 35 will hold the saw blade against the face 15.

The strength of the magnet field is selected so that the saw may readily slide to and fro to perform the cutting action whilst resisting breaking of the face to face contact between the saw blade and face 15 of the guide.

The face 16 of the guide is provided with areas 39 of a material which will promote a friction engagement with the face of a workpiece under the pressure applied to the guide by the operator. This friction engagement reduces the risk of movement between the guide and workpiece when in use.

Figure 2:
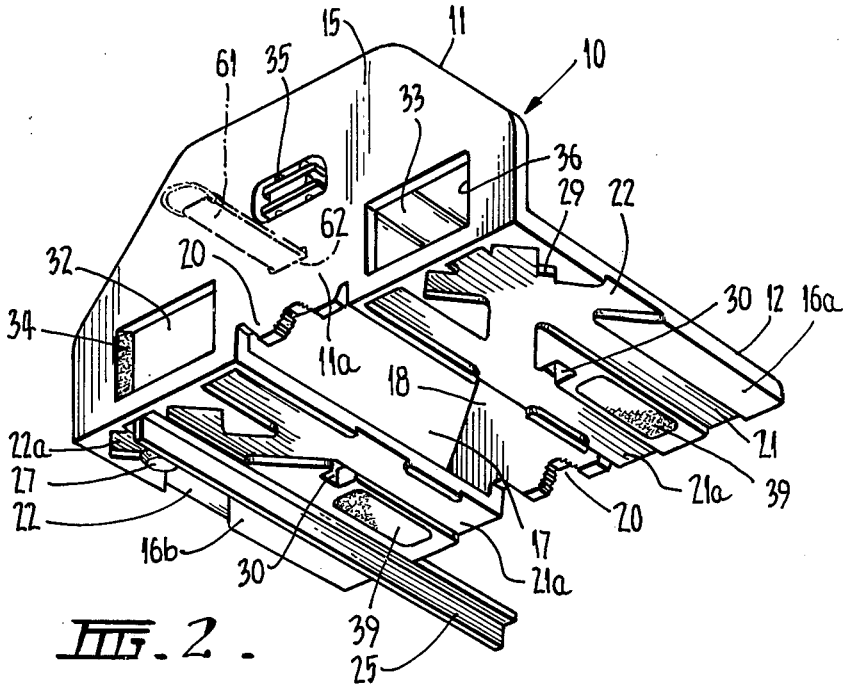
FIG. 2 is a perspective view from below of the guide.

Each of the portions 16*a* and 16*b* of the face 16 are provided with two parallel slots 21 and 21*a* and two intersecting slots 22 and 22*a*. The two parallel slots 21 and 21*a* are each at right angles to the face 15 whilst the slots 22 and 22*a* are each at 45° to the face 15 and at right angles to each other. The T-shaped bar 25 may be located in any one of the slots in either face portion 16*a* or 16*b*. As seen in FIG. 2, the T-shaped bar 25 is located in slot 21 in face 16*b* so that the cross-bar of the T is received within the slot 21 and the leg of the T projects at right angles to the face 16*b*, and also extends in a direction at right angles to the face 15. In all instances, the width and depth of the slots are such that the cross-bar of the T-shaped member 25 neatly fits therein without any lateral play, and is clamped in position by the headed bolt 27 and nut 28.

As can be seen in FIG. 2, each of the spaced faces 16*a* and 16*b* have two apertures therein, namely 29 and 30, and similar apertures are provided in the face 16*b*. When the headed bolt 27 is positioned in the aperture 29, portion of the head will overlie the three intersecting slots 21, 22 and 22*a*, and accordingly with the T-bar 25 located in any one of these slots, it may be locked in position by the headed bolt 27 positioned in the aperture 29. When the T-bar 25 is located in the slot 21*a*, the headed bolt 27 is located in the aperture 30 to overhang a proportion of the cross-bar of the T-shaped member 25, and thus clamp it firmly in position in the slot 21*a*.

The two series of slots provided in the spaced faces 16*a* and 16*b* enable the T-bar 25 to be placed in any one of eight different positions as selected by the operator to give either a right angle cross-cut or a 45° angle cross-cut to the workpiece being sawn. Also by selection of the use of the slots in either face 16*a* or 16*b* the guide can be conveniently used by either left handed or right handed persons. In the embodiment illustrated, the T-bar 25 is located in a slot in the face 16*a* for use by a right handed person, that is, the saw would be operated in the right hand of the person and the guide would be held by the left hand.

Figure 3:
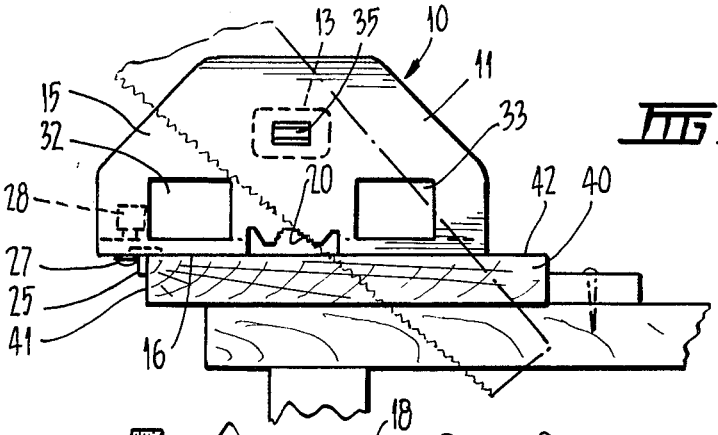
FIG. 3 is an end view of the guide in the operative position to guide a right angle cut.
Figure 4:
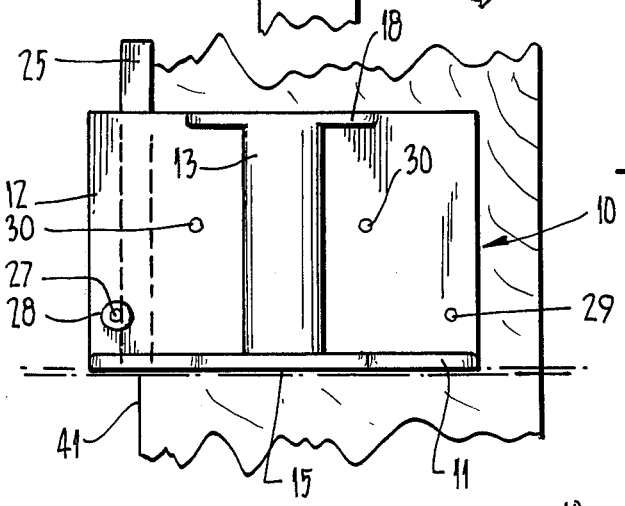
FIG. 4 is a plane view of the guide in the position shown in FIG. 3.
Figure 5:
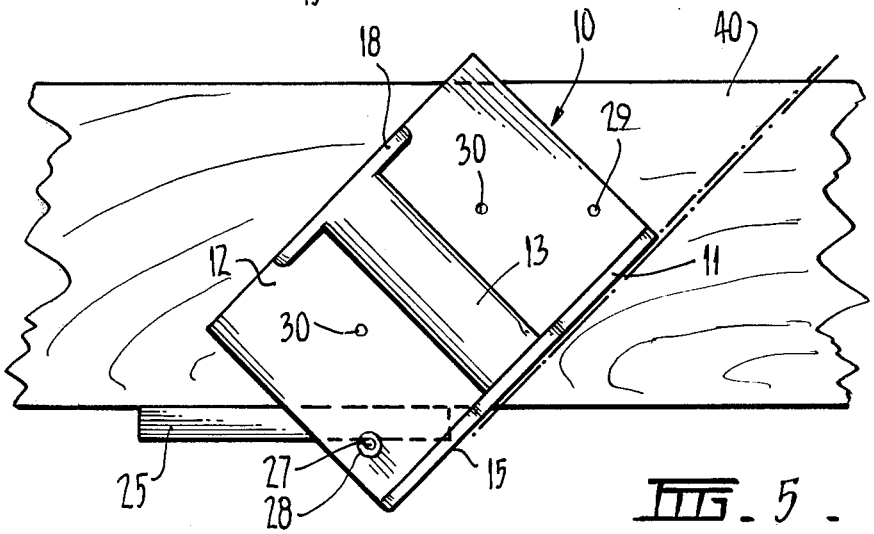
FIG. 5 is a plane view of the guide in the position to guide a 45° cut.

FIGS. 3 and 4 show the saw guide being used for sawing a piece of timber 40 with a cut at right angles to the edge 41 of the timber. The face 16 of the guide 10 rests upon the face 42 of the piece of timber 40, and thus the face 15 is perpendicular to the face 42 of the timber. The leg of the T-bar member 25 engages the edge 41 of the piece of timber with the T-bar 25 located in slot 21 in face portion 16*b* of the guide as shown in FIGS. 1 and 2, and thus the face 15 of the guide is also at right angles to the edge 41 of the piece of timber. The saw is thus placed in contact with the fact 15 of the guide so that it extends through the magnetic field of the magnet 35, and thus the blade of the saw is naturally held against the face 15 by the magnetic attraction of the blade to the magnet. The saw can thus be operated in a normal manner and will inherently remain in contact with the face 15 and thus maintains an attitude at right angles to both the face 42 of the piece of timber and the edge 41. Similarly as shown in FIG. 5, the T-bar member 25 is now located in slot 22 in the face portion 16*b*, and thus the face 15 of the guide is now located at an angle of 45° to the edge 41 of the timber. As previously explained, the saw can now be operated against the face 15 of the guide to achieve a cut across the timber 41 at the angle of 45° to the edge 41.

In FIGS. 1 and 2 there is shown in broken outline a retractable tape which may be incorporated in the saw guide. The tape housing 60 is attached to the portion 11 of the guide by any suitable means such as screws, and the aperture 62 is provided for the tape 61 to extend through. The tape 61 is graduated and/or the reference mark is arranged so that the user reads off the tape the distance from the end of the tape to the face 15 of the guide.

The claims defining the invention are as follows:

1. A hand saw guide comprising an integral moulded first member having two right angular related flat faces arranged to permit location of one face in face to face relation with a surface of a workpiece with the other face perpendicular to said surface of the workpiece, two sets of elongated grooves in said one face of the first member, said sets of grooves being spaced from one another, each set of grooves including one groove at right angles to said other face and one at 45 degrees to said other face, a second member adapted to be selectively seated in any one of said grooves with a portion of said second member projecting from said one face and extending in the direction of the groove in which it is seated, means to lock said second member in any one of said grooves, said portion of the second member being adapted to engage an edge of the workpiece when the second member is locked in a selected groove and with the one face of the first member in said face to face relation with the workpiece to thereby set the angle of the other face to said edge of the workpiece.

2. A hand saw guide as claimed in claim 1 wherein means are incorporated in said other face of the first member to create a magnetic field that will hold a saw blade of steel in contact with said other face of the first member.

3. A hand saw guide as claimed in claim 1 wherein means are provided to create a magnetic field that will hold a hand saw blade of steel in contact with said other face whilst permitting relative sliding movement therebetween.

4. A hand saw guide as claimed in claim 1, further including a retractable measuring tape mounted thereon with the tape extendable in a direction at right angles to said other face to measure distances from said other face.

5. A hand saw guide comprising an integral moulded first member having two right angular related flat faces arranged to permit location of one face in face to face relation with a surface of a workpiece with the other face perpendicular to said surface of the workpiece, two sets of elongated grooves in said one face of the first member, said sets of grooves being spaced from one another, each set of grooves including one groove at right angles to said other face and one at 45 degrees to said other face, a second member adapted to be selectively seated in any one of said grooves with a portion of said second member projecting from said one face and extending in the direction of the groove in which it is seated, means to lock said second member in any one of said grooves, said portion of the second member being adapted to engage an edge of the workpiece when the second member is locked in a selected groove and with the one face of the first member in said face to face relation with the workpiece to thereby set the angle of the other face to said edge of the workpiece, and means mounted on the first member to create a magnetic field positioned to hold a hand saw blade of steel in contact with said other face whilst permitting relative sliding movement therebetween to cut the workpiece with the hand saw blade.

6. A hand saw guide as claimed in claim 5, wherein the means to create the magnetic field is a permanent magnet mounted in said other face.

7. A hand saw guide as claimed in claim 5, wherein the first member comprises two portions disposed substantially at right angles with the first face formed on one portion and the other face formed on the other portion, and a handgrip is secured to the first member and located on the sides of the respective portions remote from the one and the other face respectively.

8. A hand saw guide as claimed in claims 5 or 1, wherein at least one area of friction material is provided on said one face of the first member to engage the workpiece when the guide is in use.

9. A hand saw guide as claimed in claim 5 including a retractable measuring tape mounted thereon with the tape extendable in a direction at right angles to said other face to measure distances from said other face.

* * * * *